US006987478B2

(12) United States Patent
Kahn

(10) Patent No.: US 6,987,478 B2
(45) Date of Patent: Jan. 17, 2006

(54) MULTI-FUNCTION PORTABLE DEVICE

(75) Inventor: Joel E. Kahn, Rockville Centre, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 442 days.

(21) Appl. No.: 10/361,743

(22) Filed: Feb. 6, 2003

(65) Prior Publication Data

US 2004/0155808 A1 Aug. 12, 2004

(51) Int. Cl.
*G08C 19/12* (2006.01)

(52) U.S. Cl. ..... 341/176; 341/173; 341/20; 235/472.01; 235/462.01

(58) Field of Cla ssification Search ..... 341/20, 173, 176; 709/217; 235/472.01, 462.01
See application file for complete search history.

(56) References Cited

U.S. PATENT DOCUMENTS

| | | | | |
|---|---|---|---|---|
| 5,962,839 | A * | 10/1999 | Eskildsen | 235/472.01 |
| 6,225,938 | B1 * | 5/2001 | Hayes et al. | 341/176 |
| 6,275,141 | B1 * | 8/2001 | Walter | 340/5.64 |
| 6,694,356 | B1 * | 2/2004 | Philyaw | 709/217 |
| 6,803,874 | B1 * | 10/2004 | Weber | 341/176 |
| 6,827,273 | B2 * | 12/2004 | Wilz et al. | 235/472.01 |

* cited by examiner

*Primary Examiner*—Albert K. Wong
(74) *Attorney, Agent, or Firm*—Fay Kaplun & Marcin, LLP

(57) ABSTRACT

Described is a multi-function portable device which includes a memory, a transmitter, a scanning arrangement for obtaining images to be stored in the memory, a processor coupled to the memory and the transmitter for generating encoded commands for transmission to a further device. The encoded commands are generated based on corresponding commands for the further device stored in the memory. The processor processed the images to extract digital data included in the image. The portable device also includes a housing situating the memory, the transmitter, the scanning arrangement and the processor.

20 Claims, 2 Drawing Sheets

MULTI-FUNCTION PORTABLE DEVICE

FIELD OF THE INVENTION

The present invention relates to portable electronic devices, and in particular to portable multi-function devices.

BACKGROUND OF THE INVENTION

In recent times, there has been a proliferation of portable electronic devices that have become an essential part of everyday life. Many of these devices are small, pocket sized, and designed to fit in user's hand and be carried routinely on a user's person. These portable devices may perform a multitude of functions; (e.g., a remote control for an automotive security system, a stereo system, etc.).

For instance, a large proportion of new vehicles have factory installed security systems that typically include an alarm system and means to lock and unlock the vehicle remotely. Some advanced systems have additional functions such as remotely starting the engine, lowering or raising the windows, etc. In addition, almost any vehicle may be retrofitted with an aftermarket alarm system which may include many of the same functions as a factory system. Practically every security system includes a remote control unit which enables the user to set or disable the alarm, lock and unlock the doors, and often permits additional functions. These units are small enough that they may be attached to a key chain and may be carried in a pocket without interfering with activities of the user.

Another type of portable device that is finding increased use is the personal consumer scanner. All products sold in stores have a unique identification code (e.g., a bar code) to identify their type and brand. These codes may be cross-referenced to find price and quantity data for a particular merchant. The codes may be read by permanently mounted scanners at a store checkout to charge for the products, or by hand-held scanners for inventory purposes. Consumers also may make use of those codes to identify merchandise and find out more information about it. The proliferation of portable pocket sized devices such as those described above does, however, create certain problems for the users. For example, many families own more than one motor vehicle with corresponding remote control devices for the security systems of those vehicles. A consumer may not be willing to carry around several car alarm remote controls as well as other portable devices. Even thought the devices may be miniaturized, carrying too many of them becomes impractical. To that end there is a need for a multi-function portable device that may scan the bar codes, serve as a car remote control, etc.

SUMMARY OF THE INVENTION

The present invention relates to a multi-function portable device. The portable device may include a memory, a transmitter, a scanning arrangement for obtaining images to be stored in the memory, a processor coupled to the memory and the transmitter for generating encoded commands for transmission to a further device. The encoded commands are generated based on corresponding commands for the further device stored in the memory. The processor processed the images to extract digital data included in the image. The portable device also includes a housing situating the memory, the transmitter, the scanning arrangement and the processor.

DETAILED DESCRIPTION

Figure 1:
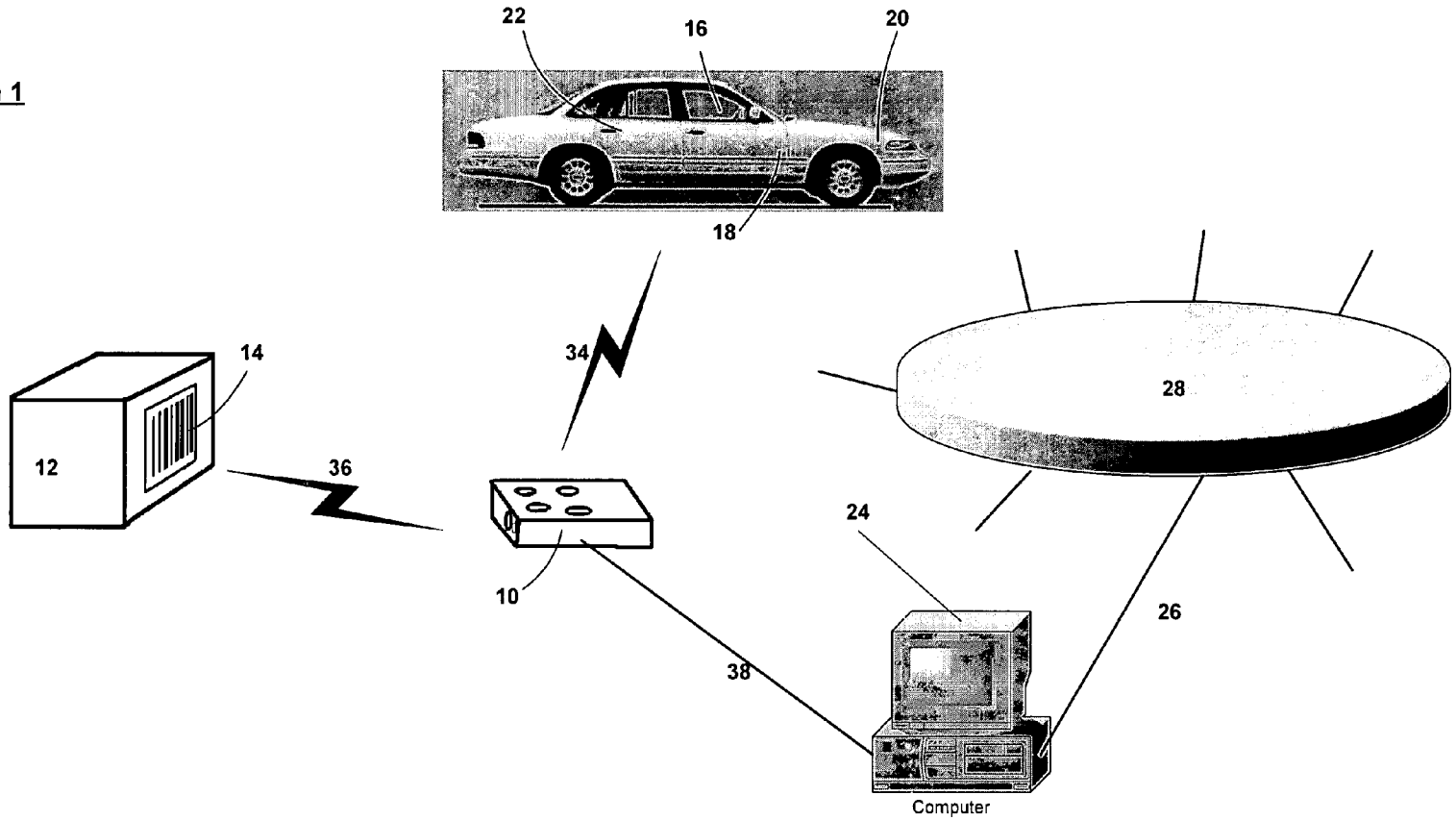
FIG. 1 shows an exemplary embodiment of a system which utilizes a multi-function portable device according to the present invention.

The present invention may be further understood with reference to the following description and the appended drawings, wherein like elements are referred to with the same reference numerals. A multi-function portable device or "MFPD", according to the present invention, may perform a plurality of functions, for example, the MFPD may serve as a remote control for a vehicle security system which is used by most drivers on the road. The MFPD may be attached to a key chain or even into a key handle so that it is always accessible when needed and poses minimal encumbrance to the user. The MFPD may have remote control functions that allow the user to lock and unlock a vehicle from a distance and to set and disable the alarm system of the vehicle. The user may also, using a "panic" button, activate the vehicle's alarm, remotely open or close windows and start the vehicle's engine.

Another function of the MFPD that users may find useful is a scanning function which enables the user to read product identification codes that are marked on practically every product. These standard codes (e.g., UPC bar codes or two-dimensional bar codes) identify the product, its origin, and may be cross-referenced to a database to derive additional information such as price, availability, rebates, etc. The user may read the bar code using the MFPD and record it for future use. The MFPD may be pocket sized so that it can be carried by the consumer and ready for use at any time.

In these applications, the product identification codes may be of any scanner-readable type, such as UPC, 2D barcodes, EAN and JAN codes. In addition, various encoding methods used in conjunction with direct mail advertisement, print advertisement or other types of media may be used. Electronic advertisement transmitted via computer networks may also contain embedded codes that identify the products being shown. These codes may provide the user with the ability to access additional information, or at least to precisely identify the products of interest. The MFPD according to the present invention is not limited to an optical scanner that reads a bar code. Instead, any type of scanner matched to any widely used system of merchandise identification may be used, as will be apparent to those of skill in the art. Codes other than those found on products may also be scanned to provide the MFPD with additional functionality.

The utilization of the MFPD may significantly increase interest and sales of products. For example, a user may utilize the MFPD to capture bar codes on retail products. The captured bar codes may be used to create a customized shopping list or gift registry list with entries precisely describing the products. They may be used to purchase the product, or simply to connect to a computer network to find more information regarding the scanned products. The MFPD is not limited to reading bar codes found on actual items of merchandise. For example, catalogs may include merchandise codes to identify the products depicted, and advertisement flyers may also include such codes. These techniques effectively convert these types of printed advertisements into a two-way communication channel between the user and the manufacturer. A fast and efficient method of entering orders is created, for example, by letting a user send a shopping list via an electronic connection, consequently reducing the need for expensive call centers to receive telephone orders.

Many advertisements may be turned into such two-way channels of communication by utilizing product identification codes together with the MFPD. When the user sends an inquiry or an order using the captured codes, for example using the Internet, it becomes possible to better target marketing messages. In addition to the information requested by the user, one-to-one marketing messages may be provided. These messages may be tailored to the interests of individual users based on the merchandise purchased and for which information is sought. A much more receptive audience for messages is therefore reached since the targeted users have already shown an interest in a specific category of goods.

FIG. 1 shows a system 1 according to an exemplary embodiment of the present invention which utilizes the MFPD 10. The MFPD 10 may be approximately the size of a regular car alarm remote control so that it may be attached to a key chain and carried in a pocket without interfering with the user's activities. The MFPD 10 may be used by a user to scan, for example, an identification code 14 that may be found on a product 12. As indicated above, the code 14 may be a bar code unique to the product 12 as is found on a wide range of products sold to the public. An optical beam 36, for example, may be used to "read" the code 14 so that the MFPD 10 may process the code.

Figure 2:
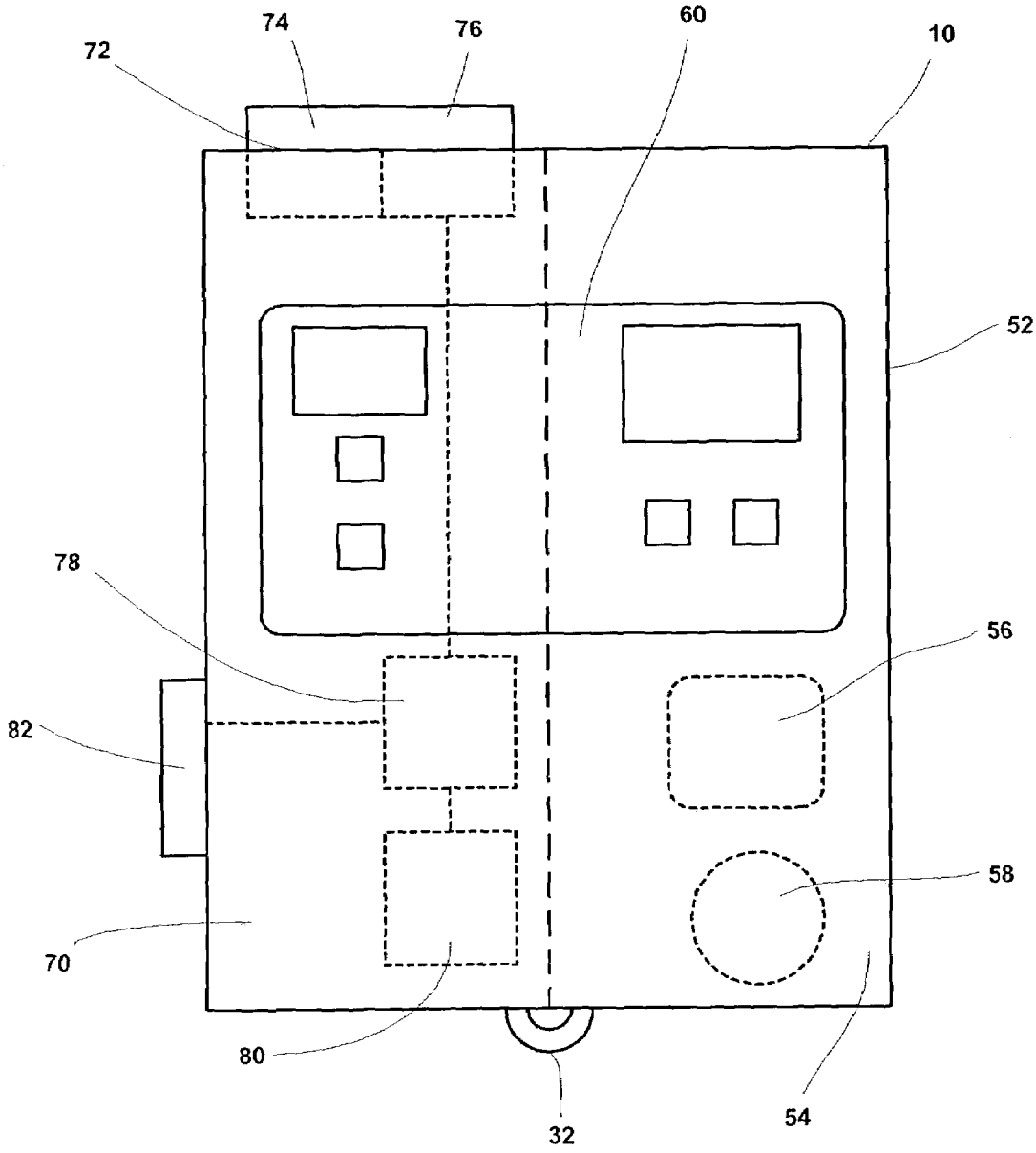
FIG. 2 shows an exemplary embodiment of a multi-function portable device according to the present invention.

In addition, the MFPD 10 may include remote control functionality to operate a security system 18 of a vehicle 16. The operation may be carried out via a wireless connection 34 between the MFPD 10 and the vehicle 16 as would be understood by those skilled in the art. The security system 18 may include an alarm 20 and a power lock control 22 so that the vehicle 16 may be unlocked and the security system 18 may be disabled from a distance. Conversely, the alarm may be set and the vehicle 16 locked, also from a distance. Both the security system 18 and the scanning of the code 14 may be controlled via a control panel 60 of the MFPD 10 (as shown in FIG. 2). Through the control panel 60 the user may activate or deactivate the security system 18 and scan the code 14 as well as operate secondary functions described below. A key chain connector 32 or similar connector may be used to clip the MFPD 10 to any suitable article.

The utility of the MFPD 10 may be further increased by utilizing an electronic connection 38 to interface with a host computer 24 or with a computer network 28 (e.g., the Internet). The data retrieved by the MFPD 10 may be sent via the connection 38 to the computer 24, where it may be further processed (e.g., by accessing information about the product 12 stored in a database). The computer 24 may further be connected to the network 28 via a connection 26 so that an even greater amount of information on the product 12 may be retrieved. In addition, a two-way data exchange may be commenced with manufacturers and sellers of the product 12, for example, to request information, receive rebates, or send targeted advertising to the user. In another exemplary embodiment according to the present invention, the MFPD 10 may be operated as a tethered scanner when connected to a host. In that function, data obtained by the MFPD 10 may be sent in real time to the host computer or network.

FIG. 2 shows an exemplary embodiment of the MFPD 10 according to the present invention. This exemplary embodiment of the MFPD 10 may perform the following functions: it may function as a remote control for a vehicle security system and may be used as a scanner for product identification codes. Those skilled in the art would understand that the MFPD 10 may perform a variety of other functions. For example, the MFPD 10 may include a portable imager (not shown) for capturing and storing images. Alternatively, the MFPD 10 may include an RFID transmitter which allows the MFPD to function as an RFID tag. Therefore, the user may utilize the MFPD 10 not only to open the vehicle 16 or scan the bar code 14, but also to take low-resolution images, pay highways tolls, etc.

The MFPD 10 preferably includes a housing 12 that has a size and shape allowing a user to easily carry it with him/her. For example, the housing 12 may be pocket sized so it may be attached to a key chain, or as a stand alone unit that will fit in a pocket or may be clipped to a belt without interfering with the user's activities. The housing 12 is preferably sufficiently resilient to protect the electronic components included therein from environmental factors, as would be understood by those skilled in the art.

The MFPD 10 may further include a transmitter 56 for sending coded commands to a receiver of the security system 18 located in the vehicle 16. These commands may preferably be encoded to prevent activation by foreign signals and may operate with radio signals, infrared signals, or other types of signals as would be understood by those skilled in the art. An electronic processor 78 performs the encoding and also controls operation of the transmitter 56 according to commands issued by the user. A variety of commands may be generated by the transmitter 56, for example, commands directing locking and unlocking a locking mechanism 22, and arming and disarming an alarm mechanism 20. In addition, other functions including, for example, a panic signal may also be directed by the transmitter 56. A battery 58 may be included in the MFPD 10 to power the transmitter 56, the processor 78 and other elements of the MFPD 10.

Although the present embodiment refers to a vehicle alarm remote control, the MFPD 10 may be modified to issue commands to a variety of types of devices in addition to or, alternatively to, the vehicle lock/alarm system described above. For example, a home security system may be controlled using the MFPD 10 by simply storing signals corresponding to the home security system in a memory arrangement 80. The MFPD 10 may also be optimized to carry out other functions, such as opening a garage door, or any other function which requires the user to carry a remote control on his person. In another example, the MFPD 10 may incorporate a cell phone or a pager. These additional functions may require a user to program the corresponding signals into the memory 80 and then recalling them using the transmitter 56 as is done presently with, for example, universal remote controls.

A control panel 60 may be disposed on the housing 52 to control operation of the MFPD 10. Multiple buttons or a single-multi function input device may be used to allow the user to select commands to be sent by the transmitter 56. For example, a first button may combine the locking and arming functions, while another button may be used as a panic button. The number and configuration of the controls on the control panel 60 may vary greatly depending on the functionality desired to be enabled in the MFPD 10 and in the mode of operation envisioned for the user. Those of skill in the art will understand that the specific configuration of the controls is not critical to the operation of the present embodiment of the invention.

To perform scanning functionalities, the MFPD 10 may include a reader 72 designed to read, for example, merchandise identification codes found on products, advertisements, catalogues etc. Although the present description is directed to an optical device that reads bar codes, the reader 72 may employ different technologies to collect images such as a low-resolution pictures, other types of identification codes, etc. In the exemplary embodiment described herein, the reader 72 includes a light source 74 which emits a light beam, laser beam, or other type of optical energy, for example using a diode. The light beam is reflected by the bar coding found on the scanned product 12, and the reflected light is collected by an optical receiver 76. The optical receiver 76 converts the received reflected light to electrical signals which are sent to the processor 78 as would be understood. For example, the optical receiver 76 may include a charge coupled device (CCD) sensing the reflected light. The processor 78 may be a conventional multi-use processor (e.g., an Intel Pentium family processor) or a specialized processor (e.g., such as these developed by Motorola and other manufacturers) configured to control operation of the reader 72 by monitoring light emission. The processor 778 also have to converts electrical signals from the CCD to the data represented by the bar code 14.

In addition, the processor 78 may control operation of the memory 80 to store therein bar codes obtained by the reader 72. The memory 80 may be any type of electronic memory, such as a memory chip, and may be formed as RAM, ROM, or any other suitable type of conventional memory. The configuration of the processor 78 may also allow a user to store in the memory 80 various inputs (e.g., comments regarding the product being scanned, etc.).

The MFPD 10 may also include an interface port 82 for connecting to the computer 24 or the computer network 28. For example, the interface port 82 may be a serial port (RS232), a parallel port, a USB port, or another type of electronic connection. The interface port 82 may also include a wireless connection (e.g., an infrared port, a radio transmitter, Bluetooth, IEEE 802. 11b, etc). When the MFPD 10 is connected to the host computer 24 or the network 28, the processor 78 may control the exchange of data with the host.

The MFPD 10 may include a power supply 58. As would be understood by those skilled in the art, the power supply may be a conventional replaceable battery or a rechargeable battery.

In one embodiment, the MFPD 10 may be used as a replacement remote control for factory installed or aftermarket vehicle security systems. In this case, the transmitter 56 may be configured to be programmable so that the MFPD 10 is able to "learn" encoded commands used by the security system. For example, the processor 78 may be used to process codes transmitted by an original remote control unit and copy those codes as in conventional learning remote controls. The copied codes would then be stored in the memory 80 to facilitate the programming of the MFPD 10 by the user.

In another exemplary embodiment according to the present invention, the MFPD 10 may be provided as a stand alone scanner without the remote control functionality. A stand alone version of the MFPD 10 may be used by the manufacturers of remote controls to incorporate into their products. The degree of integration between the stand alone version of the MFPD 10 and the rest of the remote control may be varied based on the particular circumstances. The integration may be minimal with the scanning unit only sharing a housing with the remote control, or may be maximum, with shared power supplies, processors, etc. Those of skill in the art will understand that conventional methods of manufacturing may be used to connect a stand alone version of the MFPD 10 with a separate remote control.

The present invention has been described with reference to embodiments that include a vehicle security system remote control integrated with a personal consumer scanner. However, the present invention may be also applied to integrate different functions. Accordingly, various modifications and changes may be made to the embodiments without departing from the broadest spirit and scope of the present invention as set forth in the claims that follow. The specification and drawings are accordingly to be regarded in an illustrative rather than in a restrictive sense.

What is claimed is:

1. A multi-function portable device, comprising:

a memory storing a plurality of commands for controlling at least one function of a local device;

a scanning arrangement for obtaining images to be stored in the memory;

a processor coupled to the memory, the processor processing the images to extract digital data included in the image;

a transmitter controlled by the processor, wherein in a first mode, the processor controls the transmitter to transmit the extracted digital data to a remote device and in a second mode, the processor, when a particular function of the at least one function is selected by a user, controls the transmitter to transmit one of the plurality of commands to the local device; and a housing situating the memory, the transmitter, the scanning arrangement and the processor.

2. The portable device according to claim 1, wherein the plurality of commands includes control of locking and alarm mechanisms of the further device.

3. The portable device according to claim 1, wherein the further device includes an alarm system.

4. The portable device according to claim 1, wherein the device includes a combination of a consumer scanner and a remote control for an alarm system.

5. The portable device according to claim 1, wherein the digital data to be extracted from the images corresponds to identification codes formed on surfaces to be scanned.

6. The portable device according to claim 1, wherein the memory stores user input and wherein the processor generates the commands as a function of the user input.

7. The portable device according to claim 1, wherein the transmitter includes at least one of a radio transmitter and an infrared transmitter.

8. The portable device according to claim 1, wherein the scanning arrangement includes a light source and an optical receiver.

9. The portable device according to claim 1, further comprising:

a communication arrangement transferring data between the device and a host device.

10. The portable device according to claim 9, wherein the communication arrangement is one of a serial connection, a parallel connection, a wireless connection, a network connection and a USB connection.

11. The portable device according to claim 1, wherein the scanning arrangement is an imager including one of a CCD and a CMOS.

12. The portable device according to claim 1, further comprising:

an RFID transmitter communicating with an RFID host.

13. A remote control arrangement for an alarm system, comprising:

an alarm system control section;

a scanning section integral with the alarm system control, the scanning section including an optical source and an optical receiver, the optical receiver being adapted to collect reflected light of the optical source and generating data as of function of the reflected light;

an electronic processor processing the data;

a memory configured to store the data;

an electronic interface to exchange the data with a host; and a control panel to operate the alarm system control and scanning sections.

14. The remote control arrangement according to claim 13, wherein the data includes merchandise identification codes.

15. The remote control arrangement according to claim 13, wherein the control panel includes at least one of a scan control, a memory save control and a memory erase control.

16. A consumer scanner unit for incorporation in a portable device, comprising:

a reader adapted to detect a merchandise identification code;

an electronic memory configured to store the merchandise identification code;

a control section adapted to recieve user commands; and a processor configured to control operation of the reader and transmit an output command as a function of on the identification code.

17. The consumer scanner according to claim 16, wherein the portable device is a remote control of a vehicle security system.

18. The consumer scanner according to claim 16, further comprising:

a power supply providing power to the reader, the electronic memory, the control section and the processor.

19. The device according to claim 1, wherein the memory is one of a hard drive, a RAM memory, a ROM memory and a flash memory.

20. The consumer scanner according to claim 16, further comprising:

an interface to connect the consumer scanner unit to a host.

* * * * *